US005280760A

United States Patent [19]

Edwards

[11] Patent Number: 5,280,760

[45] Date of Patent: Jan. 25, 1994

[54] SAILING CRAFT

[76] Inventor: Jesse B. Edwards, P.O. Box 7926, Sarasota, Fla. 34278

[21] Appl. No.: 898,115

[22] Filed: Jun. 12, 1992

Related U.S. Application Data

[63] Continuation-in-part of Ser. No. 801,662, Dec. 2, 1991, abandoned.

[51] Int. Cl.[5] ..... B63B 41/00

[52] U.S. Cl. ..... 114/39.1; 114/91; 114/141; 114/143

[58] Field of Search ..... 114/91, 141, 143, 39.1, 114/130, 132, 136, 138

[56] References Cited

U.S. PATENT DOCUMENTS

| | | | |
|---|---|---|---|
| 627,844 | 6/1899 | Dailey | 114/91 |
| 648,911 | 8/1900 | Beardsley | 114/149 X |
| 667,158 | 1/1901 | Webster | 114/138 |
| 704,685 | 7/1902 | Jensen | 114/143 |
| 3,610,190 | 10/1971 | Palmer | 114/39.1 |
| 3,903,827 | 9/1975 | Marcil | 114/91 X |
| 3,972,300 | 8/1976 | Adamski | 114/91 |
| 4,686,922 | 8/1987 | Burroughs | 114/143 X |

FOREIGN PATENT DOCUMENTS

| | | | |
|---|---|---|---|
| 2151195 | 7/1985 | United Kingdom | 114/91 |

*Primary Examiner*—Sherman Basinger
*Attorney, Agent, or Firm*—William M. Hobby, III

[57] ABSTRACT

A sailboat apparatus includes a hull having a bottom, bow and stern portions along with a central portion and at least one mast for supporting a sail extending above the hull. The mast is mounted to the hull for side-to-side movement relative to the hull. A keel assembly has a keel extending below the hull bottom and through the hull bottom and attached to an elongated transfer shaft rotatably mounted to the hull and having the mast coupled to one portion thereof. The keel is coupled to another portion of the transfer shaft and extends from the transfer shaft through the hull bottom into the water so that movement of the mast from side-to-side rotates the transfer shaft and the keel in the opposite direction from the mast to stabilize the sailboat. Sealing is provided for sealing the hull bottom against the incursion of water through the keel assembly opening in the hull and may include having the transfer shaft coupled through journals and covered with the seals over the shaft and sealed to the bottom of the hull. Embodiments are disclosed which mount fluid cylinders to control the movement of the mast from side-to-side and one or more mast and keels may be utilized.

7 Claims, 4 Drawing Sheets

SAILING CRAFT

This application is a continuation-in-part of the prior patent application Ser. No. 07/801,662, filed Dec. 2, 1991, now abandoned.

BACKGROUND OF THE INVENTION

This invention relates to sailing craft and especially to sailboats having a mast, keel and ballast interconnect through a transfer shaft to stabilize the boat hull.

Sailboats have usually been assembled by using a fixed hull having a fixed mast attached thereto and a fixed keel extending from the bottom and having a ballast substantially rigidly formed to the keel to aid in stabilizing the hull. The keel is heavily weighted to provide a substantial amount of ballast to add stability to the sailboat when under way. With this type of design, the lateral wind force acting on the sails causes the entire vessel to heel with the adverse affects of heeling on the hull increasing the incursion of water and with the asymmetrical underwater hull shape tending to cause veering of the craft off-course while increasing the bow wake and resistance to forward movement. This in turn increases the tendency of the craft to capsize as the stability of the boat is decreased. The heeling of the boat is generally countered by the crew shifting their weight to the opposite side of the hull to prevent the hull from capsizing and to maintain the stability of the hull.

In the past, various approaches have been tried to solve these problems, such as that shown in U.S. Pat. No. 3,972,300, which shows a sailing craft having a one-piece hull design with a unitary mast, keel, and ballast assembly mounted on the hull of the craft so that the mast, keel, and ballast assembly can rotate independently on the hull to permit the hull of the craft to float free of the wind heeling forces. In the U.S. Pat. No. 3,885,512 to Marcil, a catamaran structure is shown in which the mast and sail are also formed as a unitary structure to tilt laterally to port or starboard when the catamaran is underway. The unitary structure of the mast and the keel are rotatably mounted to the platform above the water level in the catamaran which thus reduces the complexities from that found in a conventional sailboat. The Petrovich patent, U.S. Pat. No. 4,610,212, shows another catamaran having a pivotable mast with a downwardly extending section that holds an underwater ballast. The Stoeberl patent, U.S. Pat. No. 3,747,550, shows a plastic sailboat body and keel assembly while the Webster patent, U.S. Pat. No. 667,158, shows a center board for vessels which can be raised and lowered. The Beardsley patent, U.S. Pat. No. 648,911, shows a sailing craft in which a movable mast is connected to an inclined shaft extending through the bottom of the sailboat and to a ballast. The D. Beardsley & F. A. Robinson patent, U.S. Pat. No. 537,667, shows a sailboat in which the wind pressure upon the sails causes the mast to yield and move to leeward by revolving a shaft and bearings which transmits the motion to arms and hence to a ballast without rocking the hull. In U.K. patent application 2,151,195 A to Craig, a pivoting mast for a water borne or land based vehicle is illustrated. In the Dailey patent, U.S. Pat. No. 627,844, a device for lowering and raising smoke stacks is illustrated.

In contrast to these prior art patents, the present invention provides a stable sailboat in which the shifting mast is attached to an elongated transfer shaft at one end which transfer shaft is sealed to the bottom of the boat and has the keel extending through the bottom of the boat and attached thereto which keel has a ballast mounted on the bottom thereof for maintaining the stability of the sailboat.

SUMMARY OF THE INVENTION

A sailboat apparatus includes a hull having a bottom, bow and stern portions along with a central portion and at least one mast for supporting a sail extending above the hull. The mast is mounted to the hull for side-to-side movement relative to the hull. A keel assembly has a keel extending below the hull bottom and through the hull bottom and attached to an elongated transfer shaft (or tube) rotatably mounted to the hull and having the mast coupled to one portion thereof. The keel is coupled to another portion of the transfer shaft and extends from the transfer shaft through the hull bottom into the water so that movement of the mast from side-to-side rotates the transfer shaft and the keel in the opposite direction from the mast to stabilize the sailboat. Sealing is provided for sealing the hull bottom against the incursion of water through the keel assembly opening in the hull and may include having the transfer shaft coupled through journals with O-ring seals and covered with the seal covers over the shaft and sealed to the bottom of the hull. Embodiments are disclosed which mount fluid cylinders to control the movement of the mast from side-to-side and one or more mast and keels may be utilized.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
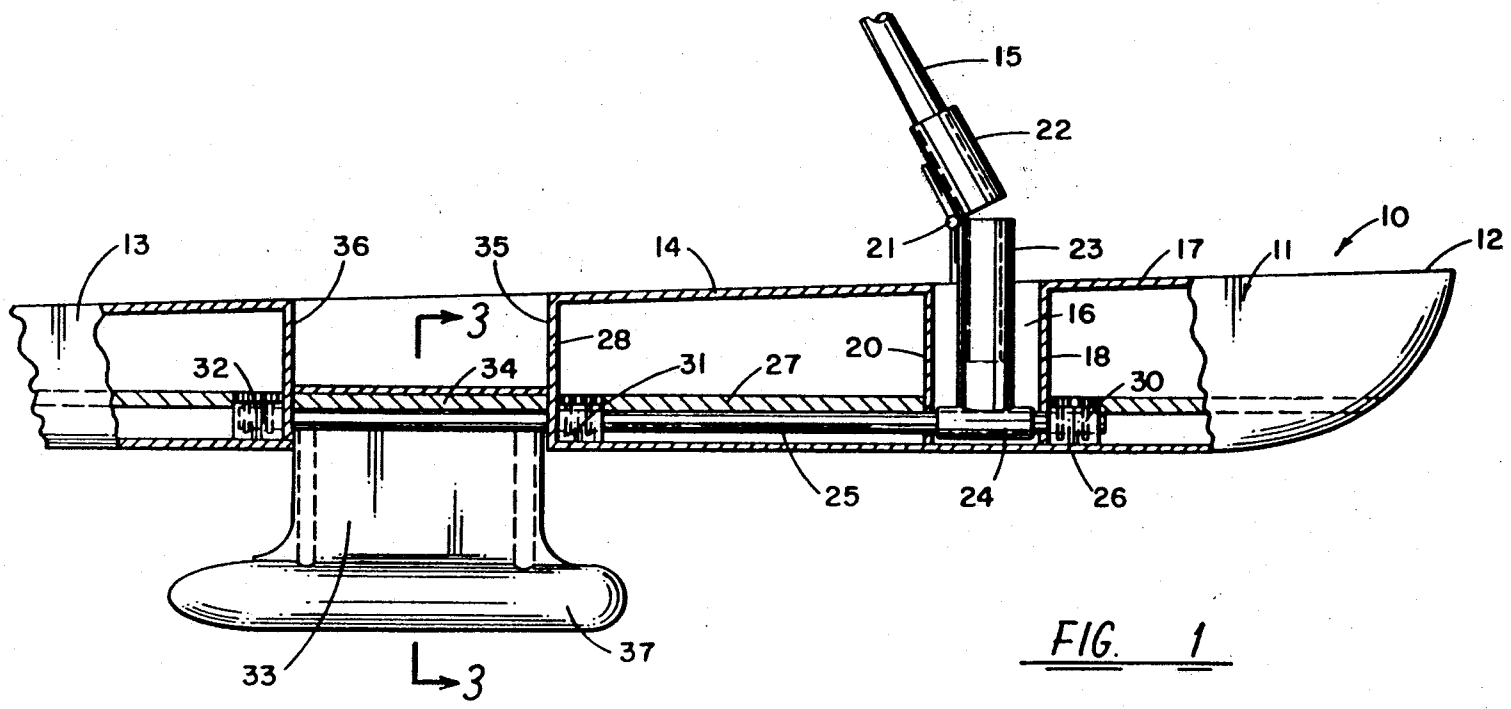
FIG. 1 is a partial side sectional view of an embodiment in accordance with the present invention.
Figure 2:
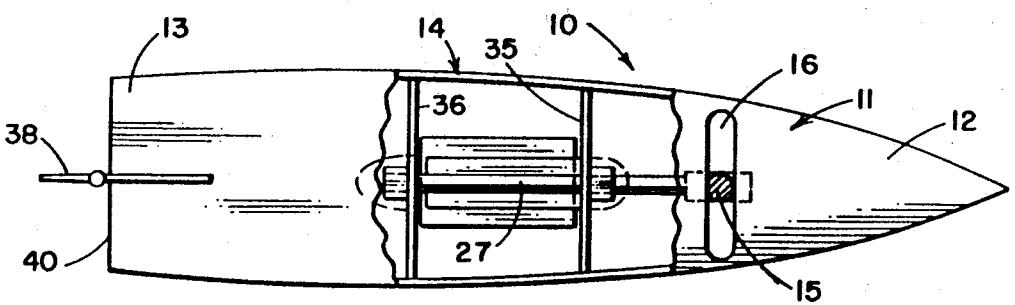
FIG. 2 is a cut-away top plan view of the sailboat in accordance with FIG. 1.
Figure 3:
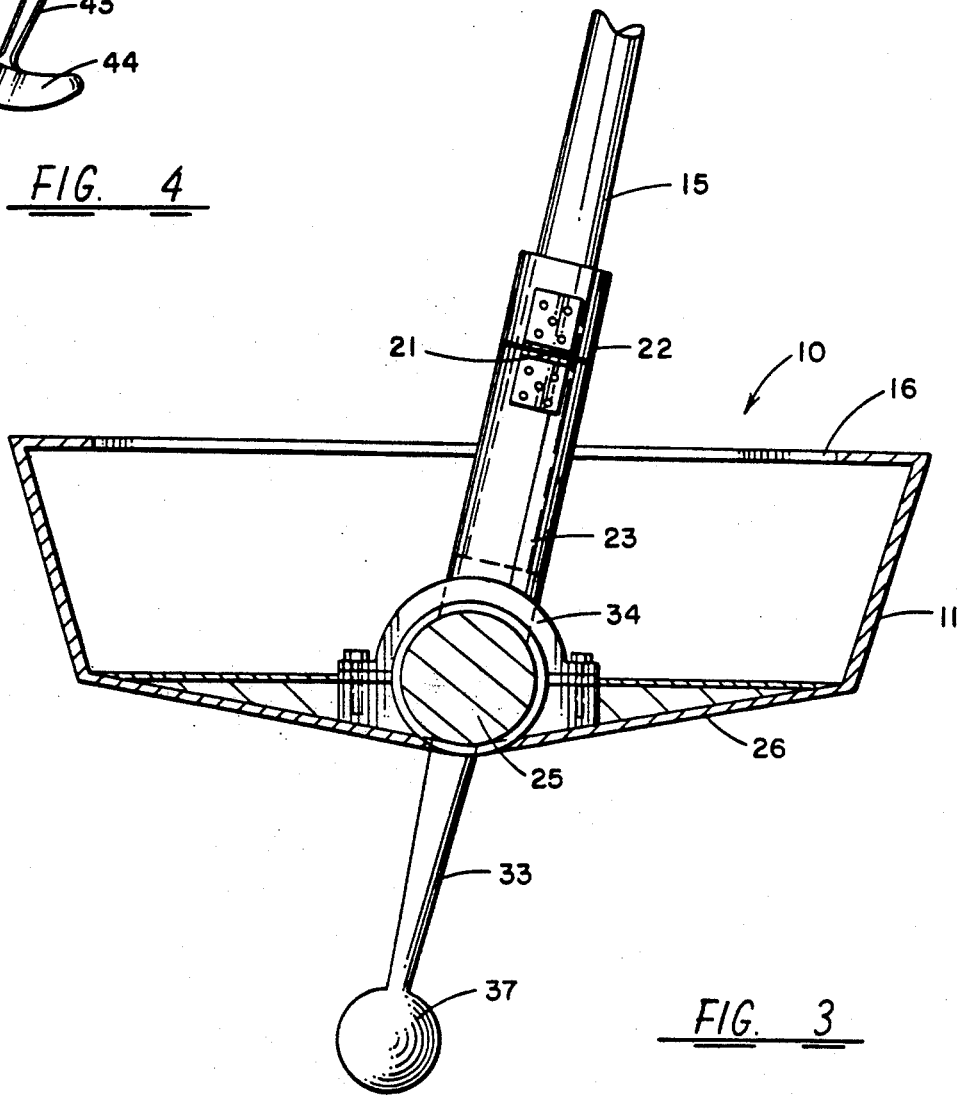
FIG. 3 is a sectional view taken on the line 3—3 of FIG. 1.

Referring to the drawings and especially to FIGS. 1, 2, and 3, a sailboat 10 has a hull 11 with a bow portion 12, stern portion 13, and a mid-section 14. The hull 11 has a mast 15 protruding through an open slot 16 through the deck 17 and which has spaced walls 18 and 20 on either side thereof. The mast 15, as shown in FIG. 1, is hinged with a hinge 21 so that the mast can be dropped and is supported in a tubular base portion 22 which allows for easy replacement of the mast 15. The mast 15, base sleeve 23 has a sleeve 24 perpendicular thereto on the bottom thereof and attached around a rotatable transfer shaft (or tube) 25. The transfer shaft 25 extends along the inside of the bottom 26 of the hull 11 and is encased with a sealing casing 27 therearound between the wall 20 and a wall 28. The shaft 25 is rotatably held in bearing journals 30, 31 and 32 each having O-ring seals therein and a keel 33 is fixedly attached to the shaft under the sealing casing 34 which sealing casing goes between a pair of walls 35 and 36 and in which the journals 31 and 32 are mounted adjacent thereto. The keel 33 has a large ballast 37 (which may be filled with lea ) mounted on the bottom thereof for adding weight to the keel and the boat includes a rudder 38 on the back thereof, as seen in FIG. 2, adjacent the transom 40 of the stern portion 13.

In operation, the mast 15 shifts in response to the wind on the sail and is allowed to move within the slot 16 rotating on the transfer shaft 25 rather than the entire hull 11 heeling with the mast 15. Rotation of the mast 15, however, rotates the shaft 25 which in turn rotates the keel 33 in the opposite direction from the movement of the mast 15 simultaneously shifting the ballast 37 to stabilize the hull 11.

Figure 4:
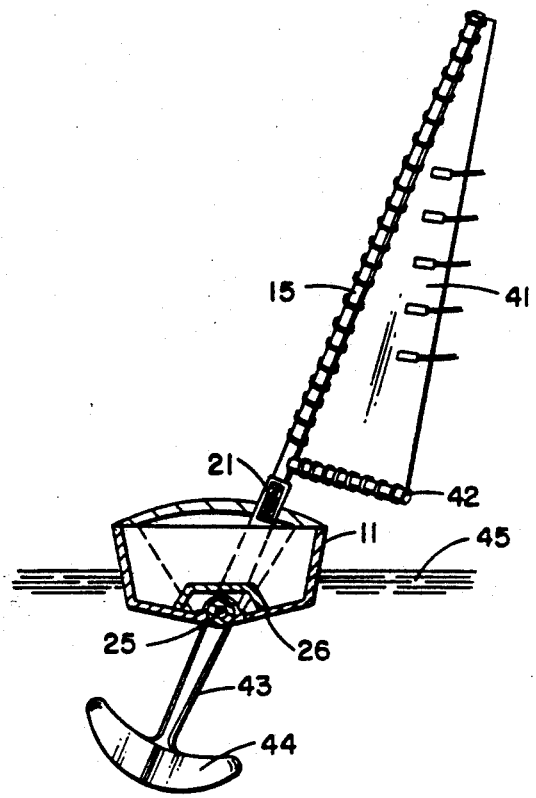
FIG. 4 is a sectional view taken through a second embodiment of a sailboat in accordance with the present invention.
Figure 5:
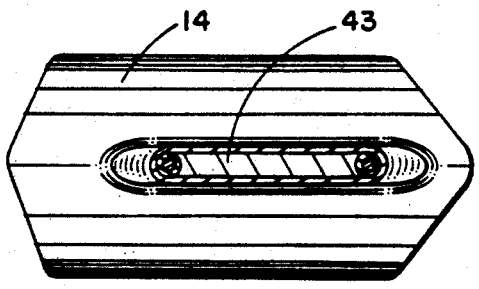
FIG. 5 is a sectional view taken through the keel 43 of FIG. 4.

Turning to FIGS. 4 and 5, a slightly modified embodiment is shown in which the hull 11 has the mast 15 with a sail 41 mounted thereto and also mounted to the boom 42 and hinged with the hinge 21 to the mechanism as described in FIGS. 1 and 2. The hull 11 has the bottom 26 and, in this embodiment, the new keel 43 is attached to the same transfer shaft 25 displaced from the attachment of the mast 15 to the same transfer shaft but with the ballast 37 of FIG. 1 is replaced with a ballast 44 having a generally air-foil shape to provide a smooth laminar flow through the water 45 in a forward direction and improves the characteristics of the side-to-side movement. As shown in FIG. 4, as the mast 15 tilts and attempts to tilt the keel 34. The ballast 44 shape improves side-to-side movement of the mast 15 while simultaneously moving the ballast 44 to an extended position on the keel 43. The shape of the ballast 44 is seen in FIG. 5 attached to the keel 43.

Figure 6:
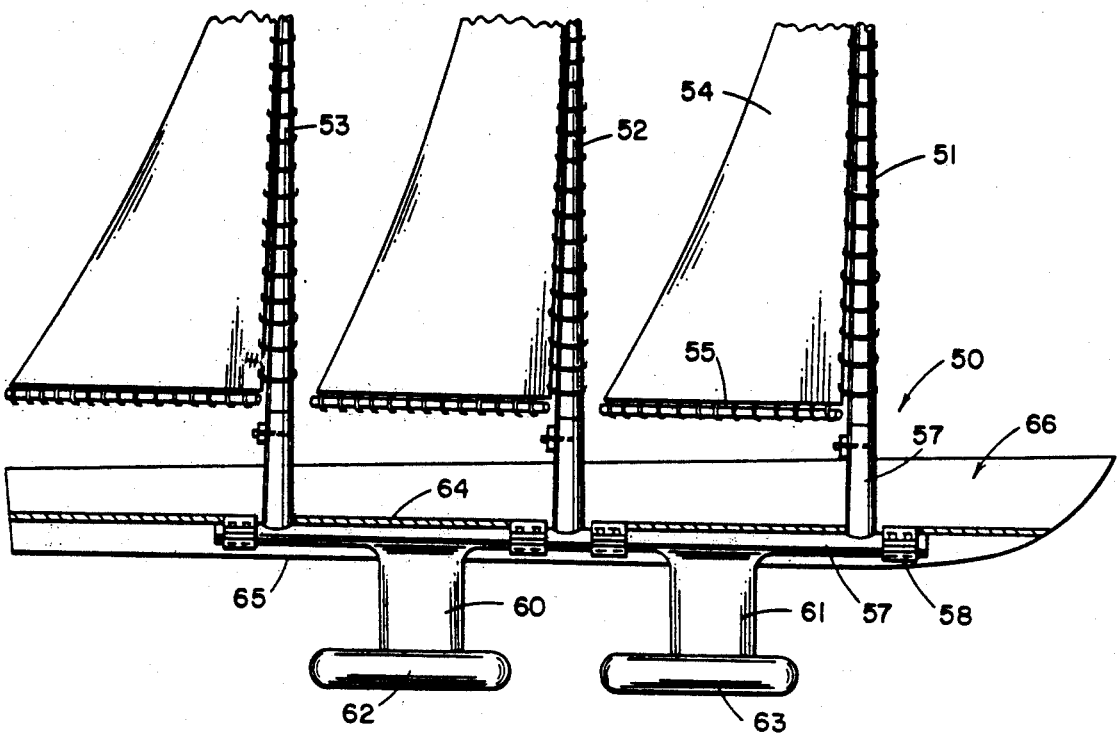
FIG. 6 is a sectional view taken through an alternate embodiment of a sailboat in accordance with the present invention.

Referring now to the embodiment of FIG. 6, a sailing craft 50 has three masts 51, 52, and 53, each having a sail 54 mounted thereto and to a boom 55 on each mast 51, 52 and 53. Each mast is attached to a supporting sleeve 56 which in turn is affixedly attached to the force transfer shaft 57 which transfer shaft is mounted in a plurality of journal bearings 58 each having sealing O-rings therein and which elongated transfer shaft 57 has a pair of keels 60 and 61 attached thereto, each having a ballast 62 and 63 attached to the end thereof. The keels 60 and 61 are fixedly attached to the transfer shaft 57 which in turn is sealed with a sealing cover 64 over the bottom 65 of the hull 66 to prevent the incursion of water through the bottom 65 of the hull 66.

Figure 7:
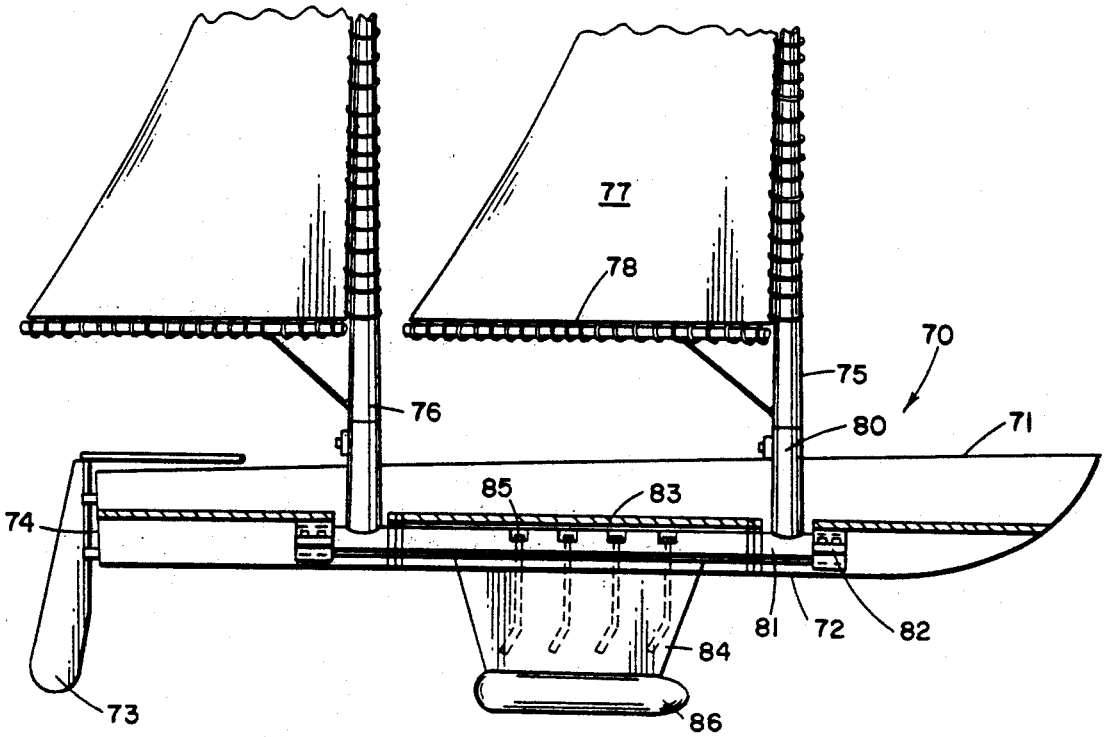
FIG. 7 is a side sectional view of yet another embodiment of a sailboat in accordance with the present invention.

Referring to FIG. 7, yet another embodiment of the sailing craft 70 is illustrated having a hull 71 with a bottom 72 and a rudder 73 mounted to the transom 74. A pair of masts 75 and 76 each have a sail 77 mounted thereto and each has a boom 78 also attached to the sails 77. Each mast 75 is attached in a mounting sleeve 80 which is attached to the transfer shaft 81 supported in a pair of journals 82 each having bearings and O-rings seals therein. The transfer shaft 80 is sealed within a sealing cover 83 and has the keel 4 attached thereto with a plurality of bolts 85 and supports a weighted ballast 86 on the bottom of the keel 84. Thus, in this embodiment, two sails are attached to the transfer shaft 81 and work in conjunction with one keel 84.

Figure 8:
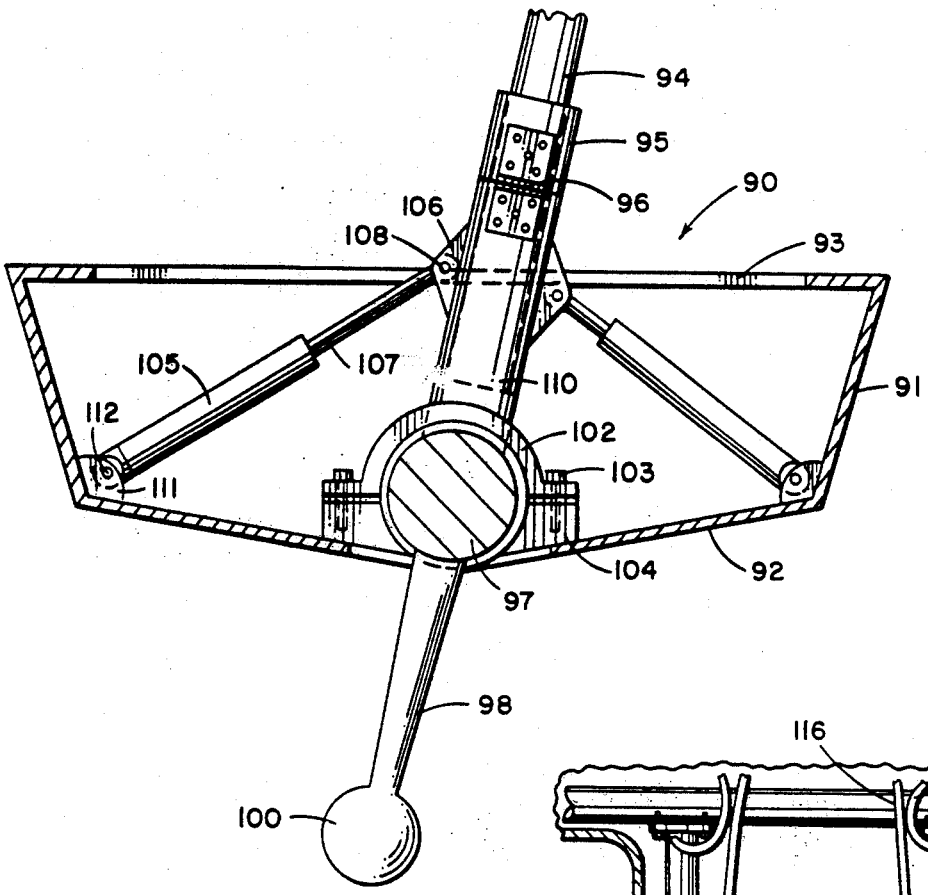
FIG. 8 is a sectional view of a sailboat in accordance with the present invention using fluid cylinders to stabilize the movement of the mast.

Referring to FIG. 8, another embodiment of a sailing craft 90 is illustrated having a hull 91 with a bottom 92 and an elongated slot 93 in the top of the hull 91. A mast 94 is attached to a sleeve 95 which is hinged at the hinge 96 and is mounted to a transfer shaft 97 which in turn has a spaced apart keel 98 fixedly attached to the shaft 97. Keel 98 has a ballast 100 attached thereto. The keel protrudes through the opening 101 to attach to the shaft 97 and has a sealing cover 102 bolted at 103 to the bottom brackets 104. In this embodiment, a pair of pneumatic or hydraulic cylinders 105 are mounted on either side of the mast 94 and are attached with brackets 106 which has the cylinder ram 107 pinned with a pin 108 to the sleeve portion 110. The ram 107 is connected to the cylinder 105 which in turn is movably attached to a hull bracket 111 with a pin 112. Thus, the cylinders 105 on either side of the mast 94 both dampen and cushion the movement of the mast 94 responsive to the wind so that the mast is forced to move more slowly against the expanding and contracting rams 107 in the cylinders 105.

Figure 9:
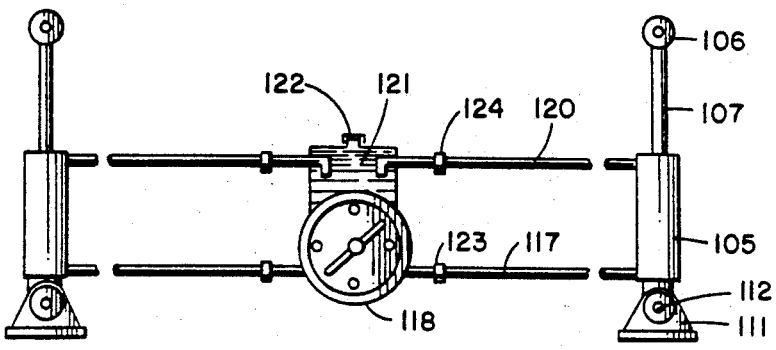
FIG. 9 is a diagrammatic view of a hydraulic system for controlling the movement of the mast in a sailboat in accordance with the present invention.

The cylinders 105 can be hydraulic or pneumatic cylinders or powered cylinders if desired. The fluid diagram of FIG. 9 shows a hydraulic diagram for controlling the hydraulic cylinders 105. The diagram of FIG. 9 has a pair of hydraulic cylinders 105 each having a hydraulic ram 107 and each pinned to a bracket 111 with a pin 112 and having attaching bracket 106 on the other end of the ram 107. Hydraulic lines 117 are fed fluid, such as a hydraulic fluid, through the valve 118 which fluid is returned through the line 120 to the reservoir 121. Reservoir 121 has a cap 122 for filling the reservoir. A check valve 123 is mounted in the line 117 and check valve 124 in the line 120. The valve 118 can be controlled to vary the hydraulic resistance of the rams 107 of the cylinders 105.

Figure 10:
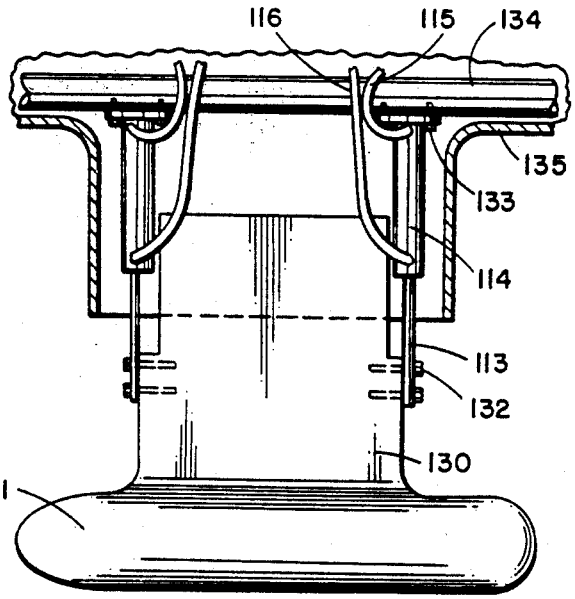
FIG. 10 is a hydraulically actuated keel for raising and lowering the keel relative to the bottom of the hull.

As shown in FIG. 10, the keel 130 has a ballast 131 and has a pair of hydraulic rams 113 and hydraulic cylinders 114 attached thereto with bolts 132. The hydraulic lines 115 and 116 are connected thereto. The hydraulic cylinders 112 are bolted with bolts 133 to the transfer shaft 134 mounted adjacent the bottom 135 of the hull. Thus, the keel 130 can be raised and lowered responsive to the actuation of a hydraulic pump (not shown) even though attached to the shaft 134 which is especially useful when towing the sail boat.

It should be clear at this time that an improved sailboat has been provided in which stability is increased in the operation of the sailing craft and which dampens the movement of the sail and hull and allows better control of the operation of the sailing craft. However, the present invention is not to be construed as limited to the forms shown which are to be considered illustrative rather than restrictive.

I claim:

1. A sailboat comprising:

a hull having a bottom and a bow portion and a stern portion and a central portion between said bow and stern portions;

at least one supporting mast extending above said hull, said mast being rotatably attached to said hull for side-to-side movement relative to said hull;

a keel assembly having a keel extending below said hull bottom, said keel assembly extending through said hull bottom, said keel having a ballast attached to the bottom thereof having a generally air foil shape with side portions providing lateral resistance to the heeling of said sailboat;

a transfer shaft rotatably mounted in said hull and having said mast coupled thereto and also having said keel coupled thereto through the hull bottom, whereby movement of said mast form side-to-side will rotate said transfer shaft and sail keel in an opposite direction from said mast to stabilize said sailboat, said transfer shaft being coupled to a plurality of bearing journals and said mast being attached thereto between two said journals;

sealing means for sealing said keel assembly from the incursion of water through the bottom of said hull; and a pair of fluid actuated cylinders attached between said transfer sheet and said keel for raising and lowering said keel.

2. A sailboat in accordance with claim 1 in which said sailboat has two masts, each said mast being attached to said transfer shaft.

3. A sailboat in accordance with claim 1 in which said sealing means is a housing attached over a portion of said transfer shaft and sealed to the bottom of said boat.

4. A sailboat in accordance with claim 1 in which said mast extends into said hull bow portion in a slot formed therein which slot has walls formed on each side thereof.

5. A sailboat in accordance with claim 4 in which said mast is attached in a hinged sleeve whereby said mast can be lowered on said hinge.

6. A sailboat in accordance with claim 1 in which said hull has two fluid cylinders mounted therein and attached to two sides of said mast.

7. A sailboat in accordance with claim 1 in which each said fluid cylinder is a hydraulic cylinder to control movement of said mast.

* * * * *